United States Patent [19]

Stumpp et al.

[11] 3,974,809

[45] Aug. 17, 1976

[54] FUEL INJECTION SYSTEM FOR SPARK PLUG-IGNITED INTERNAL COMBUSTION ENGINES WITH COMPRESSION OF THE AIR-FUEL MIXTURE

[75] Inventors: Gerhard Stumpp; Günther Jäggle; Rudolf Krauss, all of Stuttgart; Herbert Scharl, Ditzingen, all of Germany

[73] Assignee: Robert Bosch G.m.b.H., Stuttgart, Germany

[22] Filed: Feb. 27, 1974

[21] Appl. No.: 446,406

[30] Foreign Application Priority Data

Mar. 16, 1973 Germany ..... 2313164

[52] U.S. Cl. ..... 123/139 AW; 123/32 EA; 123/119 R

[51] Int. Cl.[2] ..... F02M 39/00

[58] Field of Search ... 123/139 AW, 32 EA, 32 AE, 123/140 MC, 119 R

[56] References Cited

UNITED STATES PATENTS

| | | | |
|---|---|---|---|
| 3,835,828 | 9/1974 | Knapp | 123/139 AW |
| 3,842,813 | 10/1974 | Eckert | 123/139 AW |
| 3,867,917 | 2/1975 | Zeyns | 123/139 AW |

*Primary Examiner*—Charles J. Myhre
*Assistant Examiner*—R. H. Lazarus
*Attorney, Agent, or Firm*—Edwin E. Greigg

[57] ABSTRACT

What follows is a description of a fuel injection system for spark plug-ignited internal combustion engines with compression of the air-fuel mixture and structure for controlling the system pressure. The system is one which includes a device for regulating a fuel injection quantity operating in dependence on the air quantity streaming through a suction tube of the engine, a pressure regulator for determining normal system pressure, injection nozzles which have an opening pressure lower than the system pressure, a continuously delivering fuel pump, and the structure identified above. This structure adjusts the device for regulating the fuel injection quantity so that the starting pressure in the system is retained below the opening pressure of the injection nozzles and above the vapor pressure of the fuel until a quantity of fuel sufficient to replace the quantity of fuel evaporated or leaked due to a temperature gradient in the system resulting from engine cut off has been restored.

14 Claims, 5 Drawing Figures

FUEL INJECTION SYSTEM FOR SPARK PLUG-IGNITED INTERNAL COMBUSTION ENGINES WITH COMPRESSION OF THE AIR-FUEL MIXTURE

BACKGROUND OF THE INVENTION

The present invention relates to a fuel injection system, and more particularly to a fuel injection system for spark plug-ignited internal combustion engines with compression of the air-fuel mixture, including a continuously delivering fuel pump, a fuel injection quantity regulation operating in dependence on the air quantity streaming through the suction tube of the engine, a pressure regulator for determining the normal system pressure of the installation, and injection nozzles, whose opening pressure is lower than the system pressure.

In the use of a fuel injection system of this type, difficulties can occur after shut off of the hot engine, because the subsequent high heat of the engine, which remains as a result of the lack of circulated coolant (cooling air, cooling water), can have one or both of the following effects:

1. a portion of the fuel contained in the injection system, and especially between the fuel metering location and the injection location, is vaporized. This leads to fuel shrinkage and therefore to a shortage of fuel for engine starting after the engine has cooled off; and 2. during the cooling off of the fuel, the volume shrinkage results in reducing the pressure in the closed system and elements, which operate in dependence on the pressure as does, for example, a fuel metering valve. This causes a displacement of such a valve into a position in which the air-fuel mixture supplied is too rich so that the engine floods during start up.

To these two can be added a third adverse effect resulting from a volume reduction of fuel caused by leakages which are always present. This volume reduction can lead to starting difficulties even when the engine is started hot.

OBJECTS AND SUMMARY OF THE INVENTION

It is, therefore, an object of the present invention to develop fuel injection systems in which starting difficulties of the type described do not occur.

This object and others are accomplished, according to the present invention, by providing that after the fuel pump has begun to run, the starting pressure in the fuel injection system is held below the opening pressure of the fuel injection nozzles, but substantially above the possible vapor pressure of the fuel as determined by the engine temperature, until such time as evaporated or leaked out fuel quantities have been replaced. Consequently, under influence of the starting pressure, the entire installation is filled with fuel before the pressure is increased to system pressure and the proper fuel injection process may begin. The starting pressure, however, must he held higher than the vapor pressure in order that during hot starts and during the pressure decrease to starting pressure, vaporization of the fuel in the system is avoided.

In line with an advantageous development of the present invention, regulation of the fuel injection quantity is effected by a fuel metering and quantity splitting valve having a control slide which is displaced in proportion to the air quantities streaming through a suction tube of the engine; which control slide is acted on by fuel at one of its ends in opposition to the force caused by an air metering device acting at the other of its ends. In conjunction with the metering valve, a pressure control valve is provided for determining a control pressure which is lower than the system pressure but higher than the starting pressure and the vapor pressure of the fuel; with the fuel for the pressure control valve being taken from a fuel line of the metering valve downstream from the location at which the metered and injected fuel is branched off and with decoupling of the pressures between the two pressure tap locations being accomplished by a throttle. After the internal combustion engine is stopped, it may heat up more than during normal operating conditions because of the lack of heat removal as has been described above; and because of this, the fuel injection system may also be heated, for example, to above 100°C. Due to the resulting temperature differences a volume reduction from evaporation with corresponding leakage losses of fuel from the system occurs, so that after the installation has cooled, the lost volume of fuel, which may be particularly high, has the consequence that the control slide is pulled into a position corresponding to a metering position for too much fuel, for example, to the full load position. However, because of the temporary lower starting pressure, the control slide is pushed into the zero or idle quantity position prior to the time that the fuel can reach the suction tube through the injection nozzles when system pressure is attained.

An advantageous embodiment of the present invention provides that the starting pressure is controlled by a second pressure regulating valve which can be added to the circuit by means of a magnetic valve. Only when this magnetic valve is closed can the starting pressure rise to the normal system pressure required for injection. The period of excitation of the magnetic valve can be determined by a timing switch disposed in the electrical control circuit. During the time that the injection system is being filled, it is advantageous if the control slide is in such a position that a filling of the pressure lines between the metering valve and the injection nozzles is made possible, i.e. in a fuel metering position for a larger fuel quantity. The filling of these lines, however, can be effected also in that the section of the fuel line located between the magnetic valve and the starting pressure regulating valve is connected with the individual pressure lines through lines containing check valves.

In another advantageous embodiment of the present invention, the starting pressure is determined by a storage container having a corresponding operating pressure which is connected to the system, especially ahead of the pressure decoupling throttle as seen looking in the stream direction. Advantageously, a throttle is disposed in the connecting line between the system and the storage container and a check valve is provided parallel to the throttle and in the direction leading to the storage container where this check valve is freely passable in that direction. Hence, after the fuel pump has begun to run, this storage container must first be filled until such time as the opening pressure of the injection nozzles is attained. This filling time of the storage container as the pressure increases in the fuel system suffices for filling the fuel system. The check valve achieves a more or less unhindered connection between the injection system and the storage container in the direction of the storage container in order to guarantee proper filling of the system. The throttle prevents the sudden effluent of the storage volume during the occurrence of sudden pressure changes in the fuel system, for example, because of a leak or after the fuel pump has been shut off. Such an effluent must be prevented not only for reasons of safety, but also in order to avoid "dieseling" of the engine.

DESCRIPTION OF THE PREFERRED EMBODIMENTS

Figures 1, 2:
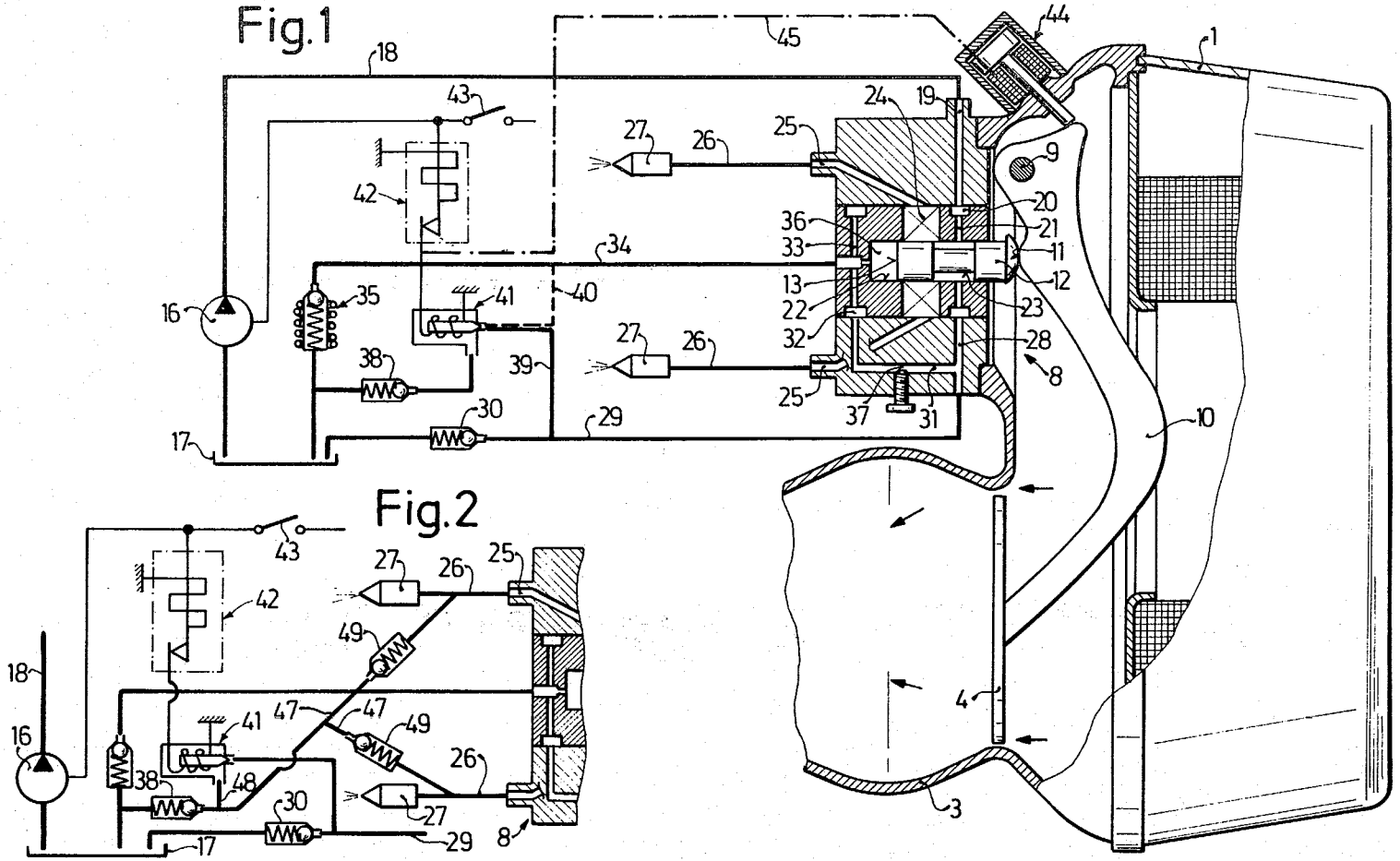
FIG. 1 illustrates a system according to a first exemplary embodiment of the present invention where the injection nozzle lines are fed directly by sliding a fuel metering and quantity splitting valve.
FIG. 2 illustrates a portion of the circuit of FIG. 1 modified to show a variation of the first exemplary embodiment where the injection nozzle lines are fed through check valves.
Figure 3:
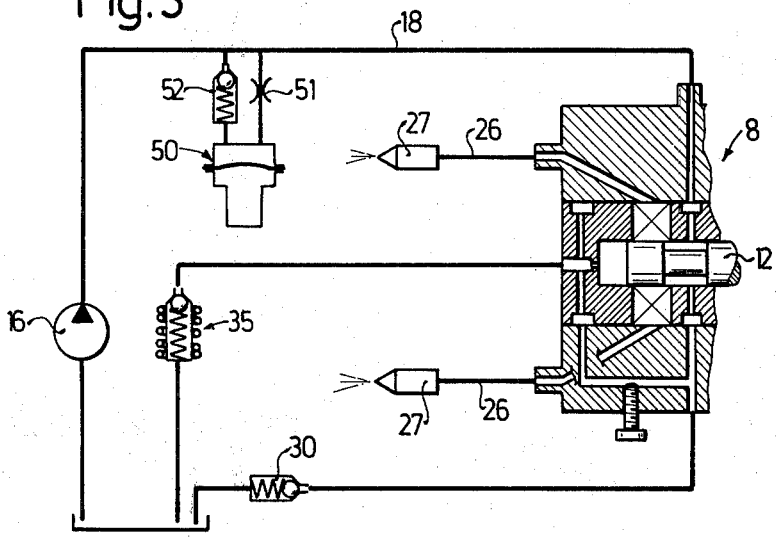
FIG. 3 illustrates a system according to a second exemplary embodiment of the present invention.

In the fuel injection systems illustrated in FIGS. 1–3, combustion air is aspirated towards the engine in the direction of the arrows through an air filter 1, a suction tube section 3, in which an air metering device 4 is disposed, and further through a suction tube section (not shown) in which an arbitrarily settable throttle flap valve is disposed. The air metering device 4 is constructed, for example, as a plate disposed transverse to the direction of the air stream. The plate 4 moves in the suction tube section 3 according to an approximately linear function of the air quantity streaming through the suction tube, where the pressure prevailing between the metering plate 4 and the throttle flap valve, which is not shown, remains constant as long as the resetting force acting upon the metering plate 4 and the air pressure prevailing ahead of the metering plate 4 both remain constant. The metering plate 4 directly controls a fuel metering and quantity splitting valve 8. The motions of the metering plate 4 are transmitted to a control slide 12 of the valve 8 by a lever 10. The lever 10 is, in turn, pivotably mounted by a pin 9 and further over a protrusion 11 of the control slide 12. The front surface 13 of the control slide 12, which faces away from the protrusion 11, is acted on by a fluid pressure serving as a resetting force for the metering plate 4.

The supply of fuel occurs through an electrically operated fuel pump 16, which aspirates the fuel from a reservoir 17 and delivers it through a line 18 to the fuel metering and splitting valve 8. From the line 18, the fuel flows into a channel 19 located within the housing of the valve 8. The channel 19 terminates in an annular groove 20 which, in turn, leads through a bore 21 to an annular groove 23 which is formed in an inner bore 22 by the control slide 12 which is positioned so that the channel 19 is in constant connection with the groove 23. Depending on the position of the control slide 12, the annular groove 23 extends over a greater or lesser amount of longitudinal control slits 24. The slits 24 provide access for the metered fuel to channels 25, each of which is connected through a line 26 to an injection nozzle 27 disposed in the suction tube. A portion of the fuel reaches a channel 28 from the annular groove 20 and subsequently travels through a line 29 and a pressure regulating valve 30 back to the reservoir 17. The pressure regulating valve 30 determines the normal pressure (system pressure) of the injection system. Branching off from the channel 28 within the housing of the valve 8 is a channel 31 which terminates in an annular groove 32. The groove 32 leads through bores 33 to a line 34 leading back to the fuel reservoir 17. In line 34 a pressure control valve 35 is placed which changes the pressure (control pressure) in the line 34 depending on engine parameters. This changeable control pressure effects the pressure in a pressure chamber 36 in the housing of the valve 8. The control slide 12 extends into this pressure chamber 36 and exposes to the pressure therein a front face 13. This pressure, together with front surface 13, determines the reset force acting at the metering plate 4. Hence, if the control pressure is changed by the pressure control valve 35, then the proportionality between the air quantity and the fuel quantity is changed and hence the air-fuel mixture is made leaner or richer. The control pressure determined by the pressure control valve 35 is always lower than the system pressure determined by the pressure regulating valve 30, which, in turn, is always greater than the opening pressure of the injection nozzles 27. For this reason, a decoupling throttle 37 is disposed in the line 31.

As soon as the warm internal combustion engine is shut off, it often occurs that the engine is heated to a greater degree than during normal operation because of the lack of circulated coolant. As a result, the fuel in the fuel injection system is also heated. This subsequent heating can reach temperatures of over 100° C and because of that, fuel is pressed or vaporized out of the fuel injection system through injection nozzles 27 or through other leaks because of its increase in volume. After the engine has cooled off, or after the vapor pressure has decreased, a negative pressure is created in the system, which leads to difficulties in starting because the fuel which is supplied must first fill up the empty spaces that have been created before a satisfactory regulation can occur. It is also possible that the metering slide 12 had been pushed, because of the lowered pressure, into a position corresponding to a large fuel metering quantity so that the internal combustion engine receives a mixture that is too rich and would continue to be too rich until such time as normal pressure conditions have been set. This leads to flooding of the engine. These difficulties are overcome in that, after the electric fuel pump 16 has begun to run, a certain pressure (starting pressure) is set for a predetermined time period within the fuel injection system, where this pressure lies below the opening pressure of the injection nozzles 27 below the control pressure and below the system pressure. This pressure should, however, if possible lie above the vapor pressure of the fuel at a temperature of somewhat in excess of 100°C in order that starting difficulties will not occur, even when the engine is started hot, i.e. when the vapor pressure prevails.

According to the first exemplary embodiment, this starting pressure is achieved by adding a second pressure regulating valve 38 which is disposed either in a line 39 branching off from the line 29 or it is disposed in a line 40, shown dotted, branching off from the line 34. This addition is effected by a magnetic valve 41, in whose electrical circuit is disposed a timing switch 42. As soon as the ignition is turned on, an electrical switch 43 of the electrical circuit of the fuel pump 16 is closed so that the pump begins to deliver fuel. Connected to the same electrical circuit is the timing switch 42 which, at this point, is still closed so that at the same time as the pump 16 begins to work, the magnetic valve 41 is opened, and the fuel in the injection system is maintained at the starting pressure corresponding to the pressure maintained by the pressure regulating valve 38. After a predetermined time interval, the timing switch 42 drops off, the magnetic valve 41 closes, and the pressure of the fuel is determined, on the one hand, by the pressure regulating valve 30 and, on the other hand, by the pressure control valve 35. A setting magnet 44 can be connected through a line 45, shown broken, to the electrical circuit existing between the timing switch 42 and the magnetic valve 41, where the setting magnet 44 actuates the lever 10 and moves it into a position in which the control slide 12, acting via the annular groove 23, opens an aperture leading to the slits 24, so that lines 26 of te nozzles 27, are filled up. As soon as the timing switch 42 drops off, the control slide 12 is pushed back into its starting position corresponding to a zero metering quantity or an idle metering quantity. According to one alternative possibiltiy, which is not shown, the setting magnet 44 and the magnetic valve 41 can be combined in a single constructional unit, and sometimes even with a single magnet.

FIG. 2 illustrates a variation of this first exemplary embodiment in which, instead of the setting magnet 44 for filling of the pressure lines 26, lines 47 are provided. Lines 47 branch off from a connecting line 48 extending between the magnetic valve 41 and the pressure regulating valve 38 and terminate in the pressure lines 26. In each of these lines 47, a check valve 49 is placed, in order to prevent fuel from flowing from line 26 to the pressure regulating valve 38 during normal operation.

The second exemplary embodiment illustrated in FIG. 3 has a storage container 50 connected to the pressure line 18 which serves to provide a temporary starting pressure. This storage container is connected to the system through a throttle 51 and a check valve 52, so that fuel can travel from the line 18, practically without hindrance, into the storage container 50, but can stream backward out of the container only in a throttled down condition. The operating pressure of the storage container 50 is below that of the opening pressure of the injection nozzle 27, so that, as long as fuel streams into the storage container 50, no injection occurs. On the other hand, the operating pressure is kept above the vapor pressure of the fuel at approximately 100°C so that when the engine is hot started, no fuel vapor can form in the system. The throttle 51 serves especially as a safety function, namely, to prevent sudden emptying of the storage container 50 if some failure of the seals should occur.

Figure 4:
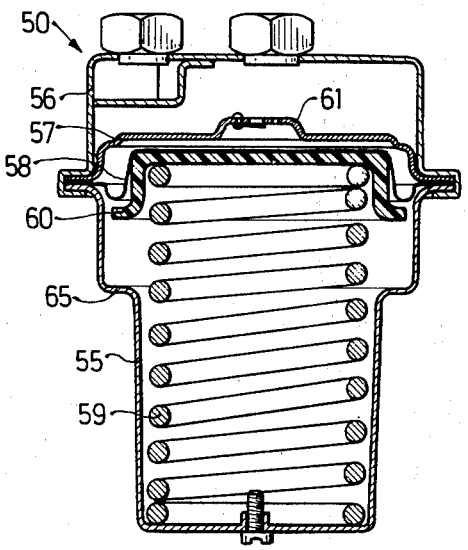
FIG. 4 illustrates the storage container used in the second exemplary embodiment in longitudinal section.
Figure 5:
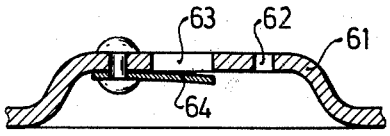
FIG. 5 illustrates the valve device used in the storage container of FIGS. 3 and 4.

FIGS. 4 and 5 illustrate the storage container 50 and a section of the container cover. The storage container 50 consists of a pot-like portion 55, a cover 56 connected thereto by a crimped flange connection, an intermediate lid 57, and a membrane 58. The intermediate lid 57 and the membrane 58 are tensioned between the flanges of the flange connection. Contained in the pot-like portion 55 is a storage spring 59 with a suitably flat characteristic curve, which acts upon the membrane 58 through a spring retainer disk 60. The intermediate lid 57 has a raised portion 61 (see also FIG. 5), penetrated by two bores 62 and 63. Bore 62 serves as the throttle 51, and bore 63, together with an elastic tongue 64, serves as the check valve 52. The storage container 50 is so dimensioned with respect to the fuel injection system that, after the delivery pump 16 has been started, the storage container can hold the fuel pressure in the entire injection system below that of the opening pressure of the nozzles 27 until such time as the metering slide 12 is in the position corresponding to idle running or the zero metering of fuel, and the spring retainer disc 60 in the storage container 50 engages a shoulder 65 in the pot-like portion 55 due to the increasing pressure, so that the pressure in the entire injection system can rise to the value determined by the pressure regulating valve 30 or by the pressure control valve 35.

What is claimed is:

1. A fuel injection system for use with spark plug-ignited internal combustion engines with compression of the air-fuel mixture, the fuel having a vapor pressure which is determined by the temperature of the engine with which the system is to be used, the system including:

a. means through which fuel for injection is delivered, for regulating a fuel injection quantity operating in dependence on the air quantity drawn into the engine with which the system is to be used;

b. a pressure regulator means for determining normal system pressure;

c. a plurality of injection nozzles connected to said regulating means for receiving the regulated fuel injection quantity, said nozzles having an opening pressure lower than the system pressure;

d. a continuously delivering fuel pump for delivering fuel to said regulating means; and e. means for adjusting said fuel regulating means so that the starting pressure in the system is retained below the opening pressure of the injection nozzles and above the vapor pressure of the fuel until a quantity of fuel has been restored in the system which is sufficient to replace the quantity of fuel lost due to a temperature gradient in the system resulting when the engine with which the system is to be used is cut off.

2. The fuel injection system as defined in claim 1, further comprising a pressure control valve, an air metering device, throttle means and means for delivering a portion of the fuel to the pressure control valve, wherein said fuel regulating means includes two pressure tap points, one of which is connected to said delivering means, and a fuel metering and quantity splitting valve having a control slide member having one end in engagement with the air metering device, said air metering device displacing through said engagement said control slide member in proportion to the air quantity drawn into the engine with which the system is to be used, and the other end in communication through said delivering means with a control pressure determined by the pressure control valve, said control pressure being lower than the system pressure and higher than the starting pressure and the vapor pressure of the fuel, and wherein said throttle means is operatively associated with said delivering means for decoupling of the pressure between the two pressure tap locations.

3. The fuel injection system as defined in claim 1, wherein said fuel regulating means includes two pressure tap points, one of which is connected to said pressure regulator means, wherein said pressure regulator means includes a first pressure regulating valve which is connected to said fuel regulating means through said connected tap point, and wherein said adjusting means includes a second pressure regulating valve and means for selectively connecting said second pressure regulating valve to said fuel regulating means.

4. The fuel injection system as defined in claim 3, wherein said means for selectively connecting said second pressure regulating valve to said fuel regulating means includes a magnetic valve and means for energizing said magnetic valve.

5. The fuel injection system as defined in claim 3, further comprising an air metering device, wherein said fuel regulating means includes a fuel metering and quantity splitting valve having a control slide member having one end in engagement with the air metering device; said air metering device displacing through said engagement said control slide member in proportion to the air quantity drawn into the engine with which the system is to be used, and wherein said adjusting means further includes means connected to said air metering device, and means for selectively connecting said second pressure regulating valve to said fuel regulating means for displacing said control slide through said air metering device into a position whereby the fuel lines leading to the injection nozzles are replenished with fuel to replace the quantity of fuel lost.

6. The fuel injection system as defined in claim 5, wherein said means connected to said air metering device and said means for selectively connecting said second pressure regulating valve to said fuel regulating means is a magnetically operated device.

7. The fuel injection system as defined in claim 6, wherein said means for selectively connecting said second pressure regulating valve to said fuel regulating means includes a magnetic solenoid valve and means for energizing said magnetic solenoid valve, and wherein said solenoid valve and said magnetically operated device have a common housing.

8. The fuel injection system as defined in claim 3, wherein said means for selectively connecting said second pressure regulating valve to said fuel regulating means includes a magnetic valve and a timing switch through which the energization of said magnetic valve is controlled.

9. The fuel injection system as defined in claim 3, wherein said means for selectively connecting said second pressure regulating valve to said fuel regulating means includes line means connected to each of said injection nozzles, with each of said line means containing a check valve.

10. The fuel injection system as defined in claim 1, wherein said adjusting means includes storage container means having an operating pressure which determines the starting pressure in the system, and wherein said storage container means is located in the system upstream of said throttle means.

11. The fuel injection system as defined in claim 10, wherein said storage container means includes a storage container, a throttle, and means connecting said throttle to said storage container and the system.

12. The fuel injection system as defined in claim 11, wherein said storage container means further includes a check valve and means connecting the check valve to said storage container and the system, said check valve opening in the direction of fuel flow into said storage container.

13. The fuel injection system as defined in claim 10, wherein said storage container means includes a storage container having a pot-like portion including a defined shoulder and defining a space within which a spring is mounted, a flexible membrane, a spring support disc, an intermediate lid, and means mounting the flexible membrane, the spring support disc and the intermediate lid to the pot-like portion, wherein the spring support engages the flexible membrane, one end of the spring engages the spring support, and the flexible membrane in its rest position engages the intermediate lid, wherein the spring support disc engages the defined shoulder for the purpose of limiting the stroke of the storage container means, and wherein the intermediate lid has a raised portion which defines a space with the flexible membrane, said raised portion having flow apertures therein.

14. The fuel injection system as defined in claim 13, wherein the storage container further includes an elastic tongue mounted to the intermediate lid so as to cooperate with one of the flow apertures, said elastic tongue and associated flow aperture serving as a check valve which opens in the direction of fuel flow into said storage container.

* * * * *